US005409170A

United States Patent [19]

Burwell et al.

[11] Patent Number: 5,409,170

[45] Date of Patent: Apr. 25, 1995

[54] IMPACTION CLASSIFIER

[75] Inventors: Donald E. Burwell, Suffield; Roger C. Emerick, South Glastonbury; James R. O'Coin, Windsor Locks; David L. Steimke, Colchester; James L. Yanosy, Granby, all of Conn.

[73] Assignee: United Technologies Corporation, Hartford, Conn.

[21] Appl. No.: 149,035

[22] Filed: Nov. 8, 1993

[51] Int. Cl.[6] ..... B05B 1/26

[52] U.S. Cl. ..... 239/515; 239/524; 239/124; 128/200.18

[58] Field of Search ..... 239/524, 518, 338, 370, 239/515, 514, 504, 124; 128/200.18, 200.14, 200.23

[56] References Cited

U.S. PATENT DOCUMENTS

| | | | |
|---|---|---|---|
| 3,404,843 | 10/1968 | Szekely | 239/338 |
| 3,838,686 | 10/1974 | Szekely | 239/338 |
| 4,560,519 | 12/1985 | Cerny | 239/338 |
| 4,588,129 | 5/1986 | Shanks | 239/338 |
| 4,792,097 | 12/1988 | Kremer et al. | 239/338 |
| 5,145,113 | 9/1992 | Burwell et al. | 239/102.2 |
| 5,152,457 | 10/1992 | Burwell et al. | 239/102.2 |

FOREIGN PATENT DOCUMENTS

| | | | |
|---|---|---|---|
| 675524 | 7/1952 | United Kingdom | 128/200.18 |

OTHER PUBLICATIONS

Lefebvre Arthur H. Atomization and Sprays, pp. 1–25 (Hemisphere Publishing Corp. New York, Washington, Philadelphia, 1989).

*Primary Examiner*—Karen B. Merritt
*Attorney, Agent, or Firm*—McCormick, Paulding & Huber

[57] ABSTRACT

An impaction classifier is provided for generating submicron sized liquid droplets. A liquid spray of liquid droplets from a primary nebulizer is directed at an impaction device, producing droplets of smaller size. These smaller droplets are directed into a chamber and around a shroud where larger droplets are separated out. The smaller droplets then exit the chamber through one or more outlet ports.

23 Claims, 5 Drawing Sheets

IMPACTION CLASSIFIER

TECHNICAL FIELD

The present invention relates generally to liquid spray generation of droplets less than 2 microns in size and more specifically to a device for generating low velocity, substantially submicron sized liquid droplets by means of an impaction surface.

BACKGROUND OF THE INVENTION

The utility of low velocity liquid sprays substantially comprised of submicron sized liquid droplets is well known and includes applications ranging from combustion processes to delivery systems for medicines. As a reference, see "Atomization and Sprays" by Arthur H. Lefebvre, Hemisphere Publishing Corporation, New York.

A number of types of devices exist for generating small liquid droplets, including pressure, rotary, or twin-fluid type, some of which utilize electrostatic, ultrasonic or other type of excitation. For an example of devices utilizing piezoelectric elements, see U.S. Pat. Nos. 5,145,113 and 5,152,457, both to Burwell et al., and both incorporated herein by reference. Many of these devices are particularly complicated and/or contain high maintenance or unreliable parts. For example, piezoelectric components are notoriously maintenance intensive, unreliable and expensive. Consequently, known spray generation devices must be designed with the piezoelectric elements accessible for maintenance and/or replacement purposes. In addition, devices currently available operate almost exclusively in the vertical or upright position, which limits their usefulness.

It is therefore desirable to develop a device utilizing impaction technology for generating liquid sprays substantially comprised of submicron sized liquid droplets at relatively high flow rates and low velocities. It is also desirable to develop a device for generating such liquid sprays which is effective in the vertical direction, and in all other orientations. It is further desirable to develop a device utilizing components of simple, reliable and inexpensive construction. The present invention is directed toward such a device.

SUMMARY OF THE INVENTION

An object of the present invention is to provide a device for generating liquid sprays comprised of submicron sized liquid droplets at relatively high flow rates and low velocities.

Another object of the present invention is to provide a device of the foregoing type which operates without regard to orientation.

Still another object of the present invention is to provide a device of the foregoing type which is without transducers.

According to the present invention, an impaction classifier for generating near submicron sized liquid droplets includes a housing having a chamber. There is also an arcuate impaction surface within the chamber. A device is provided for directing a liquid spray of liquid droplets toward the impaction surface to impinge upon the impaction surface. The device for directing the liquid spray includes a nebulizer supported in opposing relation to and spaced from the impaction surface. At least one outlet port is provided and is defined by the housing for the passage of liquid droplets from the chamber.

DESCRIPTION OF THE PREFERRED EMBODIMENTS

Figure 1:
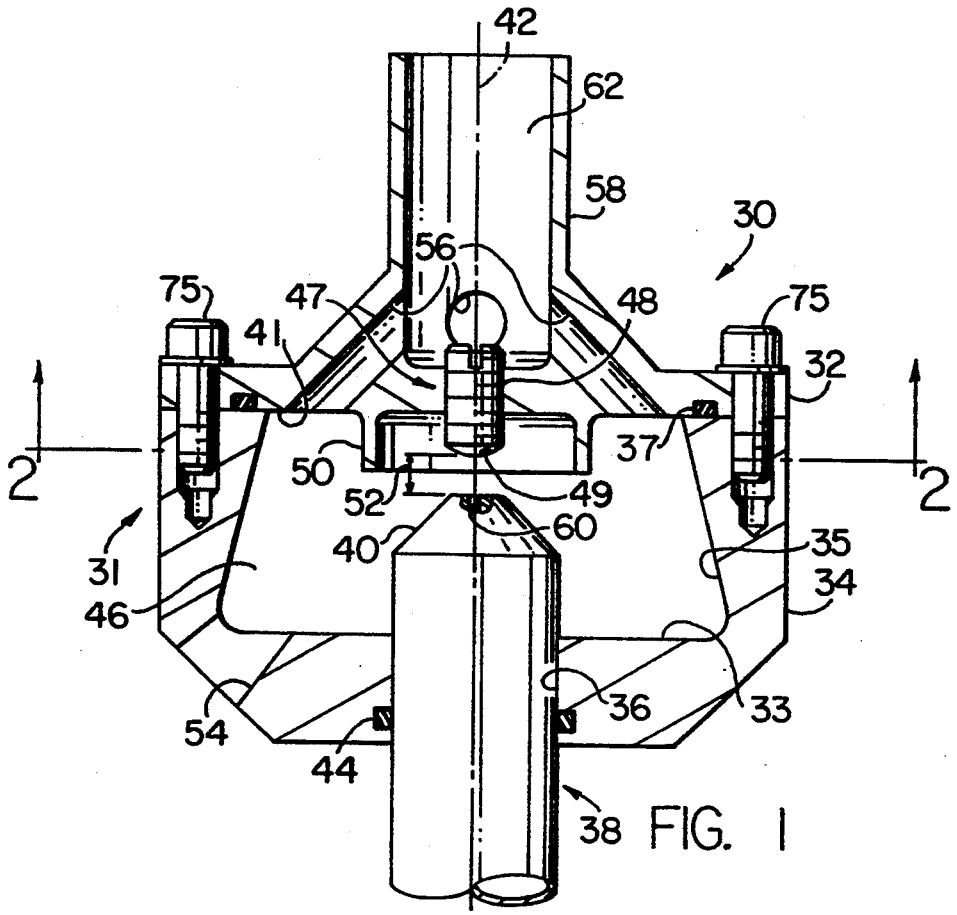
FIG. 1 is a sectional view of an impaction classifier provided according to the present invention.

FIG. 1 shows an impaction classifier, designated generally as 30, embodying the present invention for generating a low velocity liquid spray of near submicron sized liquid droplets. The classifier 30 includes a housing 31 that has upper and lower members 32 and 34. The housing may be unitary in construction and comprised of any material, depending on application. In the preferred embodiment, both the upper and lower members are comprised of a polycarbonate, such as Lexan®, marketed by Polymers Product Department of the General Electric Company.

The lower member 34 has a generally cylindrical side wall 35 and a first end wall 33. The upper member 32 defines a second end wall 41. The upper and lower members are fixed to one another by bolts 75, 75 at an interface which is sealed using an O-ring 37 or other suitable means. The upper and lower members cooperate to define a classification chamber 46, which is shown in FIG. 1 as having a generally cylindrical shape. It has been determined that the shape of the classification chamber in general does not affect performance of the device.

An input port 36 is provided in the lower member for allowing access to the classification chamber 46. A nebulizer 38 is received in the input port 36 and is sealed therein by an O-ring 44. Preferably, the nebulizer comprises a Sonocore nebulizer, and as detailed below, different nebulizers can be employed with equal effect. The nebulizer 38 includes a nozzle 40 which extends into the classification chamber 46. Preferably, the nozzle 40 has an orifice 60 of 15 mils (0.015 inches or about 0.381 millimeters).

Figure 7:
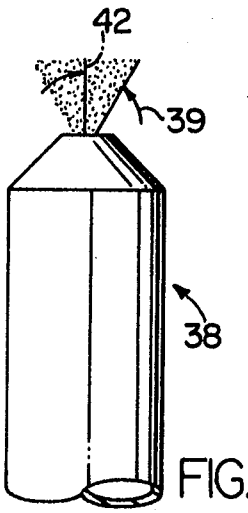
FIG. 7 is an enlarged fragmentary sectional view of a nebulizer nozzle used by the impaction classifier of FIG. 1 illustrating a spray angle of a portion of a liquid spray.

An atomized liquid spray is generated by the nebulizer. The atomized liquid spray comprises liquid droplets ranging in size from 1 to 500 microns at a flow rate between 1 and 200 ml/min. The velocity of the atomized liquid spray at the exit of orifice 60 is relatively low, on the order of 10 ft/sec. The nebulizer 38 directs the liquid spray toward an impaction device, indicated generally at 47 at a spray angle 39, shown in FIG. 7, relative to and about a central axis 42. The spray angle can range between 15° and 60° without materially affecting performance of the classifier. The optimum spray angle may differ depending upon the type of nebulizer being used.

The impaction device 47 of FIG. 1 comprises a set screw 48 having an impaction surface 49 which generally faces nozzle 40. As can be seen in FIG. 1, the impaction surface 49 is located directly above nozzle 40 and aligned along central axis 42, and this vertical orientation results in optimum performance of the classifier. Impaction surface 49 must be non-planar and is shown in FIG. 1 as being an arcuate surface convex relative to nozzle 40. In alternative embodiments (not shown) the impaction surface may be hemispherical or concave. If the impaction surface is planar, the resultant droplets are typically relatively large, i.e. greater than 5 microns, and flow rates do not exceed 2.8 ml/min.

Figure 2:
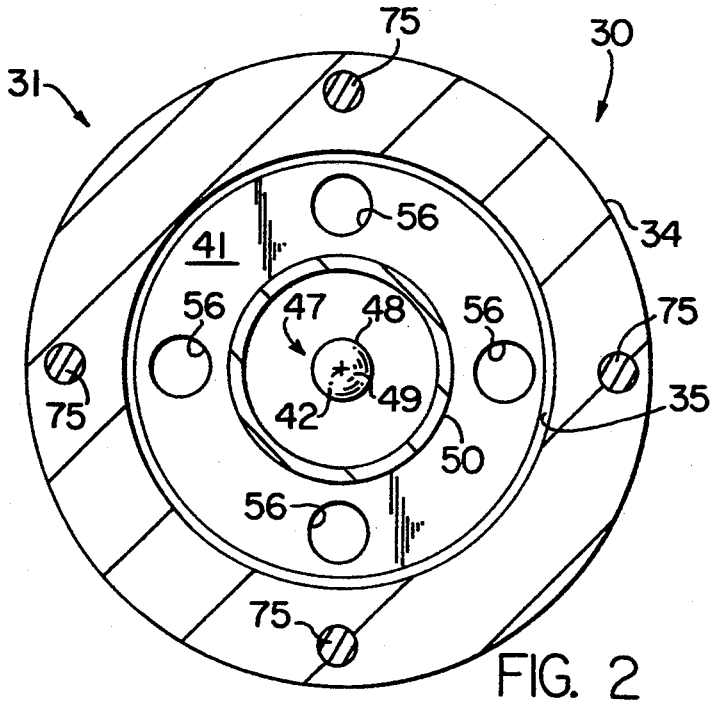
FIG. 2 is a sectional view taken along Line 2—2 of FIG. 1.

The impaction surface 49 must be wider than the width of the atomized liquid spray at the point it impinges upon the impaction surface 49 to ensure that all of the liquid spray is received by the impaction surface 49 and not some other surface. The impaction set screw 48 may be any material, and must have a circular surface, as seen in FIG. 2. The impaction surface 49 is separated from nozzle 40 by a distance 52. In the preferred embodiment, using the Sonocore nebulizer, the classifier operates in a satisfactory manner when distance 52 is between 4 and 15 mils. (0.004–0.015 inches), with a peak efficiency in terms of volume output of the classifier at distance 52 of 7 mils. (0.007 inches).

As noted above, the atomized liquid spray impinges upon the impaction surface resulting in a redirected liquid spray having smaller droplets greatly reduced in size as compared to those of the atomized spray. These smaller droplets are diverted back into the classification chamber 46. Separation shroud 50 which surrounds the impaction surface 49 aids in directing the smaller droplets back into the chamber. As seen in FIGS. 1 and 2, the shroud 50 has a generally cylindrical shape and extends from the upper member 32 of the housing 31 into the chamber 46 beyond the impaction surface.

The redirected liquid spray is diverted in order to aerodynamically separate the larger droplets from the fluid flow such that the final output spray will have smaller droplets of more uniform size. In the preferred embodiment, the droplets must make an approximately 180° turn from the impaction surface 49 to one of the outlet ports, designated 56. Particles larger than a certain size, 10 microns for example, are separated from the redirected spray as they strike a surface of the classification chamber 46, where they migrate toward the lowest part of the chamber to drain 54. Those droplets of the liquid spray smaller than a particular size, approximately 2 microns, remain entrained in the redirected liquid spray. These small droplets eventually drift back through the classification chamber and exit the classifier through one of the plurality of outlet ports 56 provided in the upper member 32.

Figure 8:
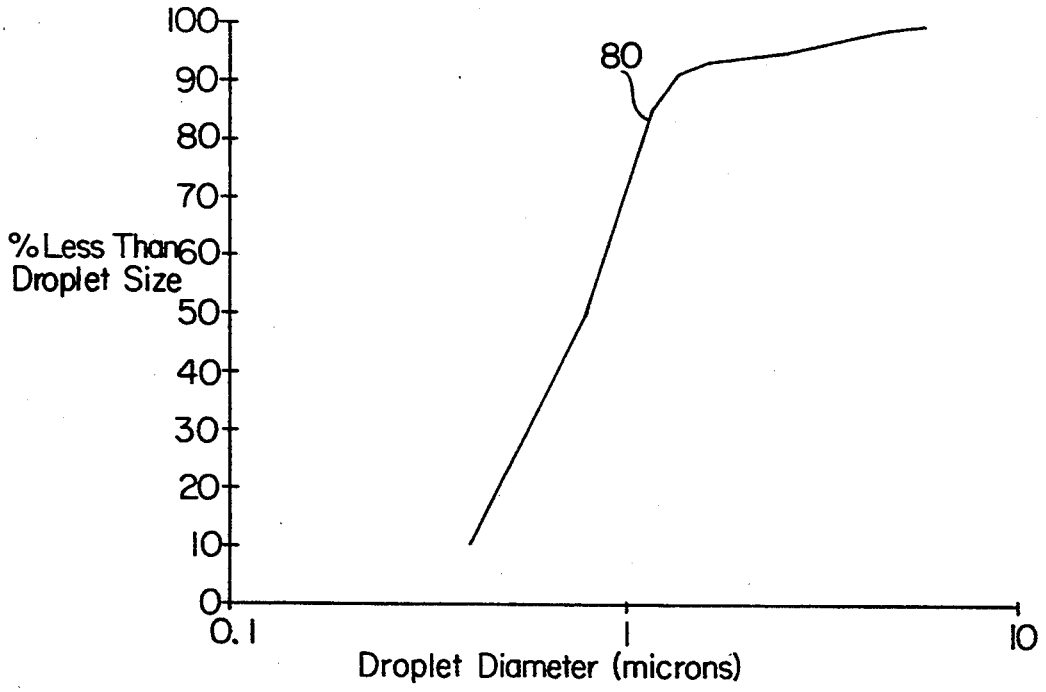
FIG. 8 is a graphical representation of the size distribution of droplets exiting the classifiers when the classifier of FIGS. 1–5 operates in the vertical orientation.

In the preferred embodiment, as shown in FIG. 2, there are four outlet ports 56 which are arranged symmetrically about the central axis 42. The outlet ports 56 are inclined relative to the central axis 42 and converge into a single outlet conduit 58 defining a passage 62. As can be seen by way of reference curve 80 of FIG. 8, the resultant flow of liquid droplets from the passage 62 of the preferred embodiment has a flow velocity of approximately 10 ft/sec., and comprises droplets smaller than 10 microns, with approximately 90% of the droplets being smaller than 2 microns. In addition, the resultant flow rate in excess of 3 ml/min comprised of extremely fine droplets is considered a very high flow rate.

FIG. 2 also shows the relative locations of selected elements of the present classifier. The impaction surface 49 has a circular shape, as viewed along the central axis 42, and is centered on central axis 42. The separation shroud 50 is also circular as seen along the central axis 42 and likewise is centered about that axis. The classification chamber 46 is also shown as having a circular cross-section.

Figure 4:
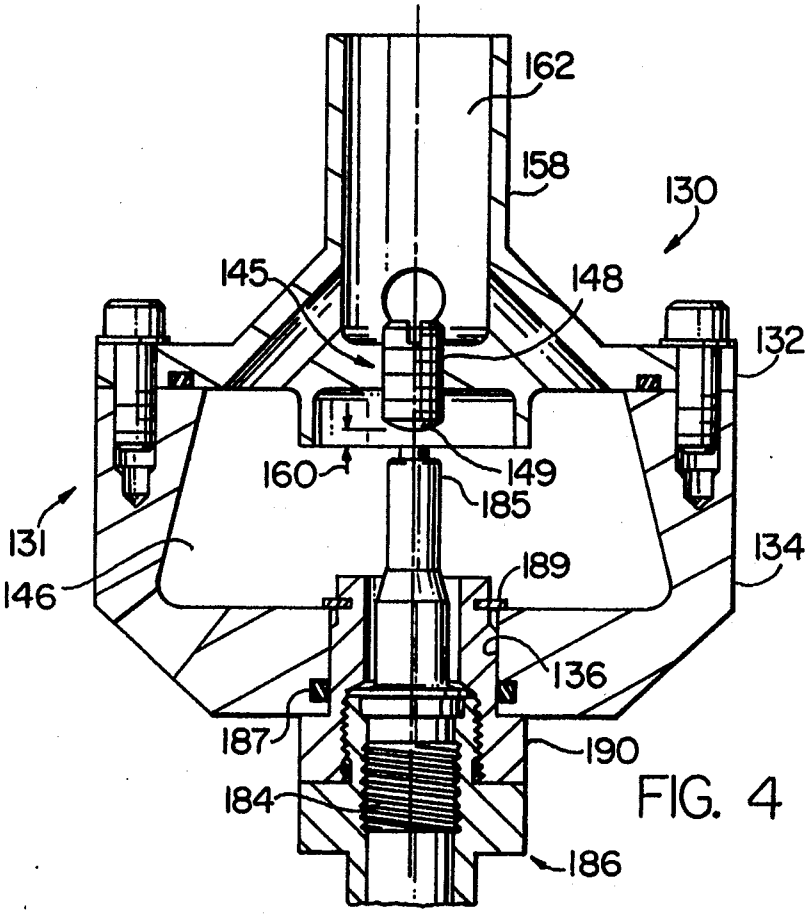
FIG. 4 is a second sectional view of the second embodiment of FIG. 3.
Figure 3:
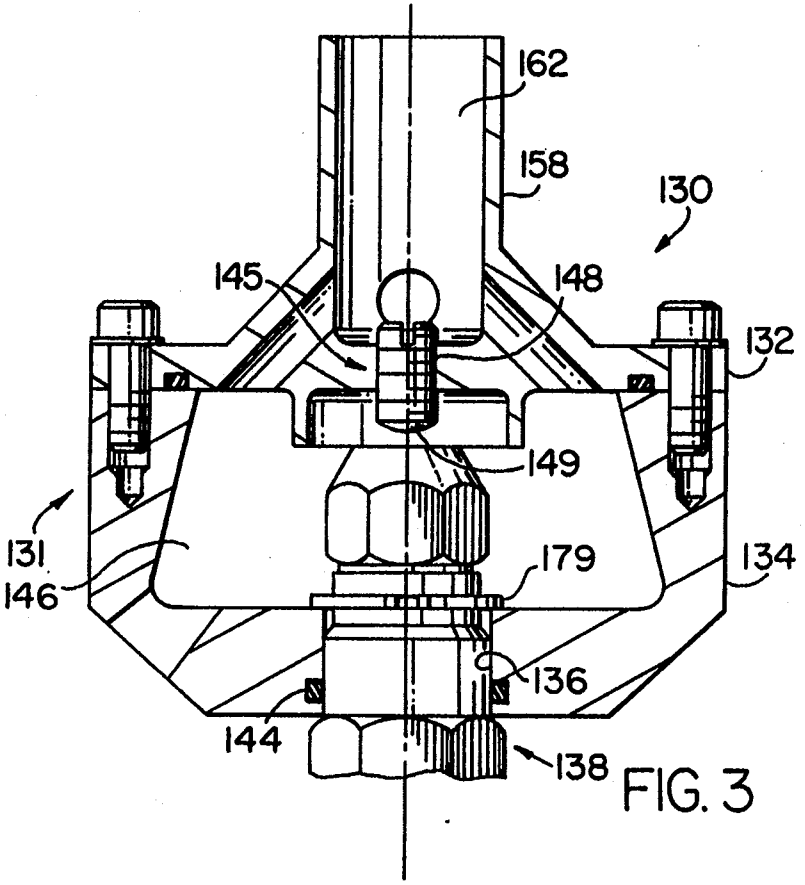
FIG. 3 is a first sectional view of a second embodiment of the present invention having a nozzle adapter that allows for the use of different nebulizers.

Another classifier 130 provided by the present invention that allows for the use of different types and brands of nebulizers is shown in FIGS. 3 and 4. The classifier 130 is similar to the classifier 30 and includes a housing 131 including upper and lower members 132, 134 that form a chamber 146 when assembled.

An input port 136 is provided in the lower member 134 for allowing access to the chamber 146. A nebulizer 138, similar to the nebulizer 38 in FIG. 1, is received in the input port 136 and is sealed therein by an O-ring 144. A snap retention ring 179 fixedly retains the nebulizer 138 in the input port 136.

To fit a different type of nebulizer into the input port 136, an adapter 190 is used. As shown in FIG. 4, nebulizer 186 is a Hamilton Standard plain-jet nebulizer. Nebulizer 186 is longer than the Sonocore nebulizer shown in FIG. 3 and has a narrower body 184 and nozzle 185. The adapter 190 allows the nebulizer 186 to be fitted in the input port 136 so that the nozzle 185 and impaction surface 149 are spaced apart a selected distance 160. Sealing is again accomplished with an O-ring 187 and retention snap ring 189, or equivalent is employed to similar effect.

As detailed above, the operation and performance of the device depends upon the spacing between the nozzle of the nebulizer and the impaction device. Since the exact length of the nebulizer and the fitting of the nebulizer into the input port may not be known exactly, a mechanism, designated generally at 145, is provided for finely adjusting the spacing between the nozzle and the impaction surface 149. In FIGS. 3 and 4, mechanism 145 provides for the movement of the impaction surface 149, rather than the nebulizer. The mechanism 145 comprises a set screw 148 which is threadably engaged in the housing 131 and also has an end which defines the impaction surface 149. The other end of the set screw 148 is accessible via passage 162 defined by outlet conduit 158. By turning the set screw 148, the spacing between the nozzle and the impaction surface is adjusted.

Figure 5:
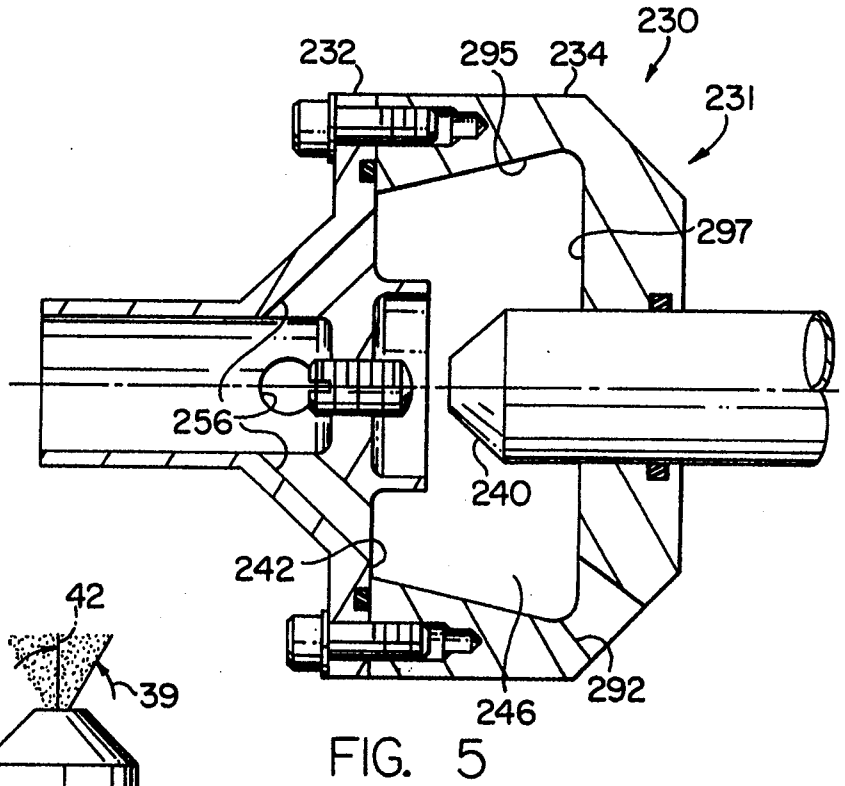
FIG. 5 is a sectional view of a third embodiment of the present invention showing a drain port and a specially shaped chamber.

Yet another embodiment of the present invention, rotatable between the upright and horizontal operating positions, is shown in FIG. 5. A classifier 230 is rotatable and operates between these positions as the result of a special shape of chamber 246, coupled with the addition of a drain port 292 which communicates with the chamber. The embodiment of FIG. 5 is otherwise similar to the embodiment shown in FIGS. 1 and 2 and includes a housing 231 comprising an upper member 232 and a lower member 234. The lower member 234 defines a side wall 295 and a first end wall 297. The upper member 232 defines a second end wall 242. The upper and lower members are fixed to one another and cooperate to define a classification chamber 246. The chamber 246 has a generally frustoconical shape, and is converging from first end wall 297 towards second end wall 242 and outlet ports 256. When the classifier is operated in the upright position, as demonstrated in FIG. 1, first end wall 297 defines the bottom of the chamber.

During separation of the liquid spray, described previously, the large droplets strike some surface of the chamber, migrate downwards to the lowest point of the chamber 246 and pool. The drain port 292 is located along the intersection of first end wall 297 and side wall 295 and serves to drain the pool from the chamber 246 so that the pool cannot grow large enough to block the nozzle 240 or outlet ports 256.

Figure 9:
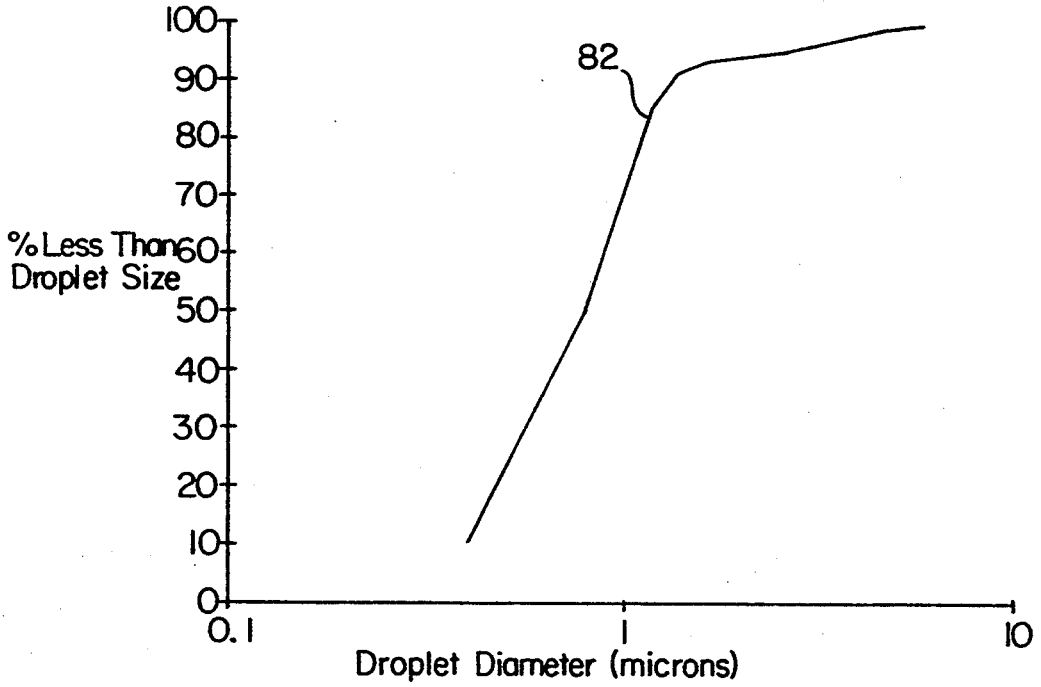
FIG. 9 is a graphical representation similar to FIG. 8, when the classifier of FIG. 5 operates in the horizontal orientation.

From the upright position, the classifier can be rotated toward the horizontal operating position shown in FIG. 5 while keeping drain port 292 at or near the bottom of the chamber 246. As long as the drain port 292 remains at or near the bottom of the chamber 246 so that excess fluid is drained, the classifier may be operated satisfactorily. In this horizontal operating position, the classifier performance as measured by output droplet size and flow rate substantially approximates that of the upright position, as shown by curve 82 of FIG. 9.

Figure 6:
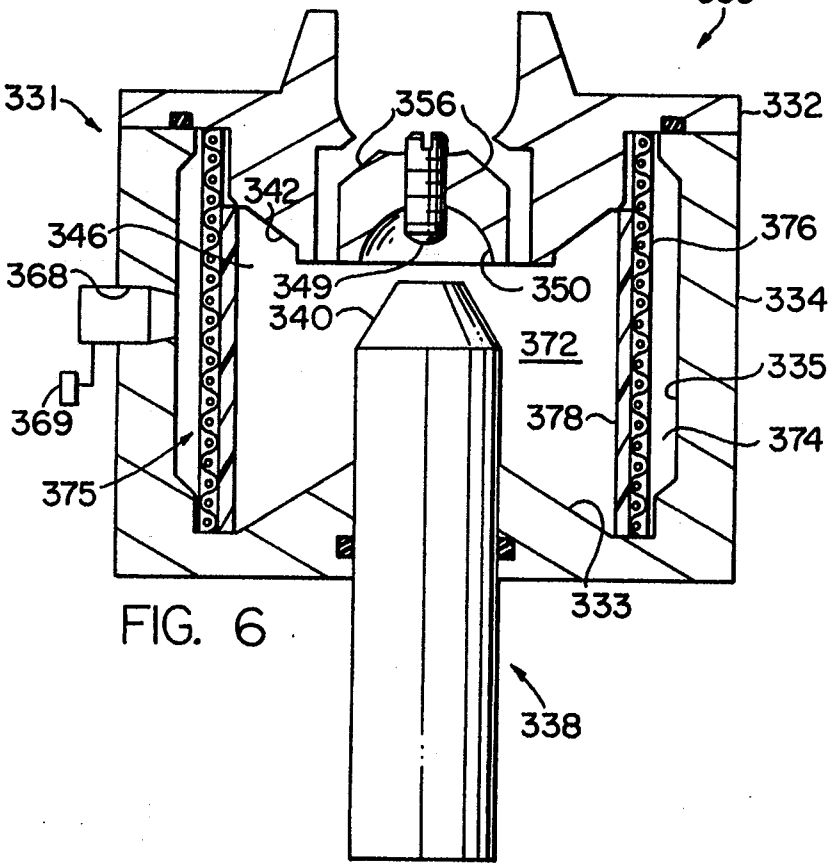
FIG. 6 is a sectional view of a fourth embodiment of the present invention showing a porous metal screen, hydrophilic liner and drain port which allows for use of the impaction classifier in any orientation.

Still another embodiment of the present invention, shown in FIG. 6, is capable of operation in any orientation. Classifier 330 includes a housing 331 which includes an upper member 332 and a lower member 334. The lower member 334 defines a generally cylindrical side wall 335 and a first end wall 333. The upper member 332 defines a second end wall 342. The upper and lower members are fixed to one another and cooperate to define classification chamber 346, which is shown in FIG. 6 as having a generally cylindrical shape.

Chamber 346 is divided into an inner chamber 372 and an outer chamber 374 by dividing means, indicated generally at 375. The inner chamber partially contains the nebulizer 338, including nozzle 340, the means defining the impaction surface 349 and shroud 350, and communicates with the outlet ports 356. The outer chamber 374 surrounds the inner chamber 372, and communicates with a drain port 368.

The dividing means shown in FIG. 6 comprise a porous metal screen 376 which is cylindrically shaped and extends between the first 333 and second 342 end walls. The screen provides 2 micron pores through which liquid passes. The screen 376 is lined on the inner chamber facing side with a hydrophilic liner 378. The liner 378 comprises a highly aromatic polyaramid material, and is preferably comprised of Nomex®.

The classifier 330 generates droplets and has a structure substantially as described above. A nebulizer 338 directs the liquid spray toward and to impinge upon an impaction surface 349 which generally faces nozzle 340. The impaction surface 349 must be wider than the width of the liquid spray at the point the liquid spray impinges upon the impaction surface 349, to ensure that all of the liquid spray is received by the impaction surface 349 and not some other surface.

After impinging on the impaction surface 349, the droplets comprising the liquid spray are diverted back into the classification chamber 346. This is aided by separation shroud 350 which is similar to shroud 50 of FIG. 1. The redirected liquid spray is diverted around shroud 350 between the impaction surface 349 and the outlet ports 356. Larger droplets are separated from the redirected liquid spray and strike and remain on some surface of the inner chamber 372, an end wall 333, 342 or the hydrophilic liner 378 of screen 376.

Figure 10:
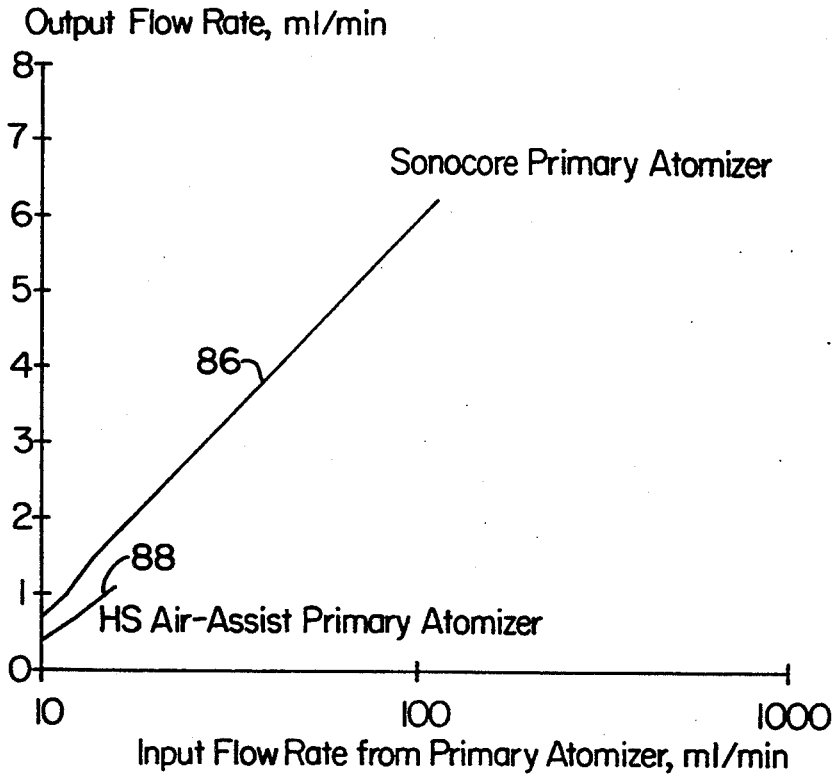
FIG. 10 is a graphical representation of output versus input flow of the classifier of FIG. 6.

The end walls 333, 342 are inclined so as to urge those droplets striking an end wall towards the hydrophilic liner 378. A pressure differential is created between the inner chamber 372 and outer chamber 374. The pressure in the outer chamber 374 is reduced by means of a rotary pump 369 which communicates with the drain port 368. A pressure in the outer chamber of at least 1 psi lower than a pressure in the inner chamber is satisfactory. As the inner chamber 372 is not pressurized other than by the flow from the nebulizer, the differential causes the larger droplets residing on a surface of the inner chamber 372 to be drawn from the inner chamber 372 into the outer chamber 374 where they are drained via drain port 368. The output flow rate is constant regardless of orientation, as shown in FIG. 10 by curve 86 using the Sonocore nebulizer.

Different embodiments can be combined, if desired. For example, the orientation insensitive classifier may be fitted with the adapter (not shown), to allow for use of different nebulizers. The output flow rate of such an arrangement using a Hamilton Standard nebulizer is shown by curve 88 of FIG. 10.

From the foregoing, an impaction classifier for generating low velocity liquid spray of near submicron sized liquid droplets has been described in some detail. It will be recognized that numerous changes and modifications may be made without departing from the spirit and scope of the invention. For example, one or more the various features described herein can be combined. Accordingly, the invention has been described by way of illustration rather than limitation.

We claim:

1. An impaction classifier for generating micron-sized liquid droplets comprising:

a housing having a chamber;

means defining an arcuate impaction surface within said chamber;

means for directing a liquid spray toward said impaction surface to impinge upon said impaction surface and including a nebulizer with an orifice supported in opposing relation to and spaced from said impaction surface for providing the liquid spray at a pressure greater than atmospheric pressure, said nebulizer including means for providing liquid to the nebulizer at a pressure greater than atmospheric pressure;

an annular shroud defining a shroud recess, said impaction surface being located within said shroud recess; and at least one outlet port defined by said housing for the passage of liquid droplets from said chamber.

2. An impaction classifier as set forth in claim 1 including adjusting means for varying the spacing between said nebulizer and said impaction surface.

3. An impaction classifier as set forth in claim 2 wherein said adjusting means is further characterized as means accessible externally of said housing.

4. An impaction classifier as set forth in claim 3 wherein said adjusting means comprises an adjustable member supported by said housing and defining said arcuate impaction surface.

5. An impaction classifier as set forth in claim 4 wherein said adjustable member comprises an adjustment screw threadably engaged in said housing.

6. An impaction classifier as set forth in claim 1 including a drain port communicating with said chamber for removing liquid from said chamber.

7. An impaction classifier as set forth in claim 1 wherein said housing defines at least one outlet port arranged outwardly of and in annular relation to said shroud.

8. An impaction classifier as set forth in claim 7 wherein said housing defines four outlet ports arranged outwardly of and in annular relation to said shroud.

9. An impaction classifier as described in claim 1, said means for directing a liquid spray providing said liquid spray at a flow rate between 1 to 200 ml/min.

10. An impaction classifier as described in claim 1, said liquid spray comprising liquid droplets of between 1 and 500 microns.

11. An impaction classifier as described in claim 1, said means for directing a liquid spray toward said impaction surface provides said liquid spray at a spray angle.

12. An impaction classifier as described in claim 11, wherein said spray angle ranges between 15° and 60°.

13. An impaction classifier for generating micro-sized liquid droplets comprising:

a housing having a chamber;

means defining an arcuate impaction surface within said chamber;

means for directing a liquid spray toward said impaction surface to impinge upon said impaction surface and including a nebulizer supported in opposing relation to and spaced from said impaction surface, said nebulizer having a nozzle with an orifice of fifteen mils (0.015 inches) in diameter; and at least one outlet port defined by said housing for the passage of liquid droplets from said chamber.

14. An impaction classifier for generating micron-sized liquid droplets comprising:

a housing having a chamber;

means defining an arcuate impaction surface within said chamber;

means for directing a liquid spray toward said impaction surface to impinge upon said impaction surface and including a nebulizer supported in opposing relation to and spaced from said impaction surface, said means defining an arcuate impaction surface spaced from said means for directing a liquid spray by a distance of between 4 and 15 mils (0.004–0.015 inches); and at least one outlet port defined by said housing for the passage of liquid droplets from said chamber.

15. An impaction classifier as described in claim 16, said distance equal to 7 mils (0.007 inches).

16. An impaction classifier for generating micron-sized liquid droplets comprising:

a housing having a chamber;

means defining an arcuate impaction surface within said chamber;

means for directing a liquid spray toward said impaction surface to impinge upon said impaction surface and including a nebulizer supported in opposing relation to and spaced from said impaction surface;

a drain port;

means for dividing said chamber into an inner chamber containing said means defining an arcuate impaction surface and said means for directing a liquid spray and communicating with said at least one outlet port, and an outer chamber around said inner chamber and communicating with said drain port; and means for providing a reduced pressure within said outer chamber which is lower than a pressure within said inner chamber; and at least one port defined by said housing for the passage of liquid droplets from said chamber.

17. An impaction classifier as set forth in claim 16, said reduced pressure means comprising a rotary pump in communication with said drain port.

18. An impaction classifier as set forth in claim 17, said rotary pump providing a pressure within said outer chamber of about 1 psi lower than a pressure in said inner chamber.

19. An impaction classifier as set forth in claim 16, said dividing means comprising a porous metal screen and a hydrophilic material.

20. An impaction classifier as set forth in claim 19, said hydrophilic material comprising a highly aromatic polyaramid.

21. An impaction classifier as set forth in claim 16 including means for adjusting the spacing between said nebulizer and said impaction surface.

22. An impaction classifier for generating micron-sized liquid droplets comprising:

a housing having a chamber defined by a generally cylindrical side wall and a pair of axially opposing, radially disposed end walls;

a coaxial, generally cylindrical shroud formed on said housing and projecting in an axial direction from one of said end walls;

means defining a convex impaction surface disposed within said shroud and having an axis of curvature coincident with the axis of said shroud, said convex impaction surface facing in the direction of the other of said end walls;

means for directing liquid spray toward said impaction surface to impinge upon said impaction surface and including a nebulizer coaxially supported by said housing in axially spaced relation to said impaction surface;

a plurality of circumaxially-spaced outlet ports defined by said housing and opening through said one end wall outwardly of said shroud; and at least one drain port opening through the other of said end walls.

23. An impaction classifier as set forth in claim 22 wherein said shroud extends outward toward said liquid spray directing means at least as far as does said impaction surface.

* * * * *